US007576273B2

(12) United States Patent
Uno et al.

(10) Patent No.: US 7,576,273 B2
(45) Date of Patent: Aug. 18, 2009

(54) HAMMER KEYBOARD SYSTEM AND CHASSIS

(75) Inventors: Shiro Uno, Hamamatsu (JP); Hitoshi Sato, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 0 days.

(21) Appl. No.: 11/582,778

(22) Filed: Oct. 18, 2006

(65) Prior Publication Data

US 2007/0068360 A1 Mar. 29, 2007

Related U.S. Application Data

(62) Division of application No. 10/833,767, filed on Apr. 28, 2004, now Pat. No. 7,141,729.

(30) Foreign Application Priority Data

May 16, 2003 (JP) ..... 2003-138978
May 16, 2003 (JP) ..... 2003-139057

(51) Int. Cl.
*G10C 3/18* (2006.01)

(52) U.S. Cl. ..... 84/236; 84/433

(58) Field of Classification Search ..... 84/236, 84/235, 174, 433
See application file for complete search history.

(56) References Cited

U.S. PATENT DOCUMENTS 5,243,125 A * 9/1993 Yamaguchi ..... 84/745
5,610,352 A * 3/1997 Yamaguchi ..... 84/435
5,821,443 A * 10/1998 Masubushi ..... 84/433
6,191,351 B1 * 2/2001 Niitsuma ..... 84/720
2002/0038595 A1 * 4/2002 Suzuki et al. ..... 84/423 R

FOREIGN PATENT DOCUMENTS

JP 11-175054 7/1999

OTHER PUBLICATIONS

Japanese Office action; dated Nov. 20, 2007; 2 pages.

* cited by examiner

*Primary Examiner*—Jianchun Qin
(74) *Attorney, Agent, or Firm*—Foley & Lardner LLP

(57) ABSTRACT

A hammer with simplified structure and reduced costs that maintains its capability as a mass body to impart a touch weight. The hammer is configured such that it is possible to fix the two mass plates to the metal base plate by means of a single rivet. Therefore, the number of places in which the rivet holes are drilled and disposed in both mass plates and the metal base plate are kept to a minimum, and it is possible to limit the lightening of the weight of both mass plates and the metal base plate by that amount. As a result, since it is possible to configure the base plates and the metal base plate with smaller dimensions while maintaining the required weight, the capability as a mass body to impart a touch weight can be maintained while preventing the enlarging of the hammer overall.

34 Claims, 8 Drawing Sheets

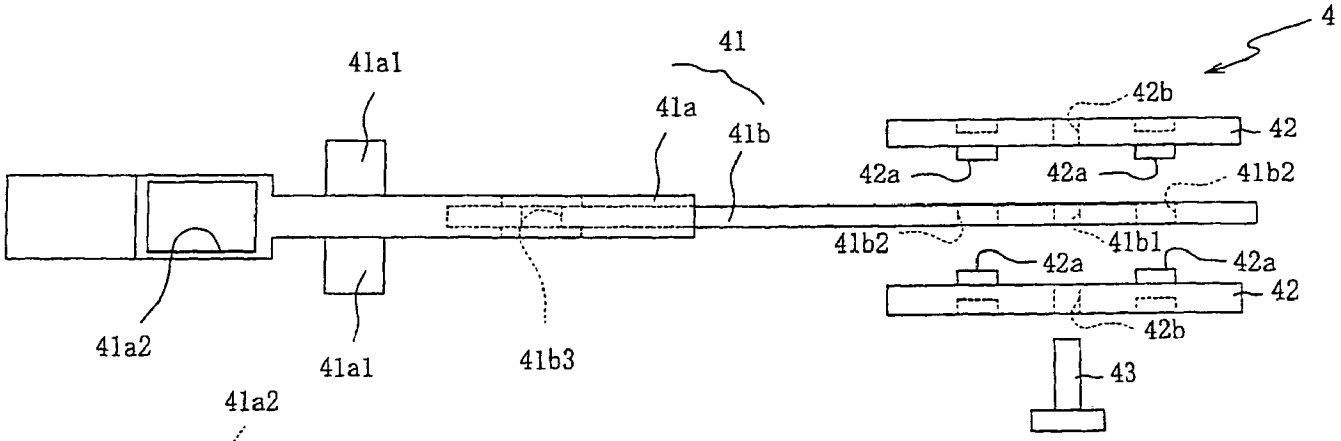
FIGURE 4 ( a )
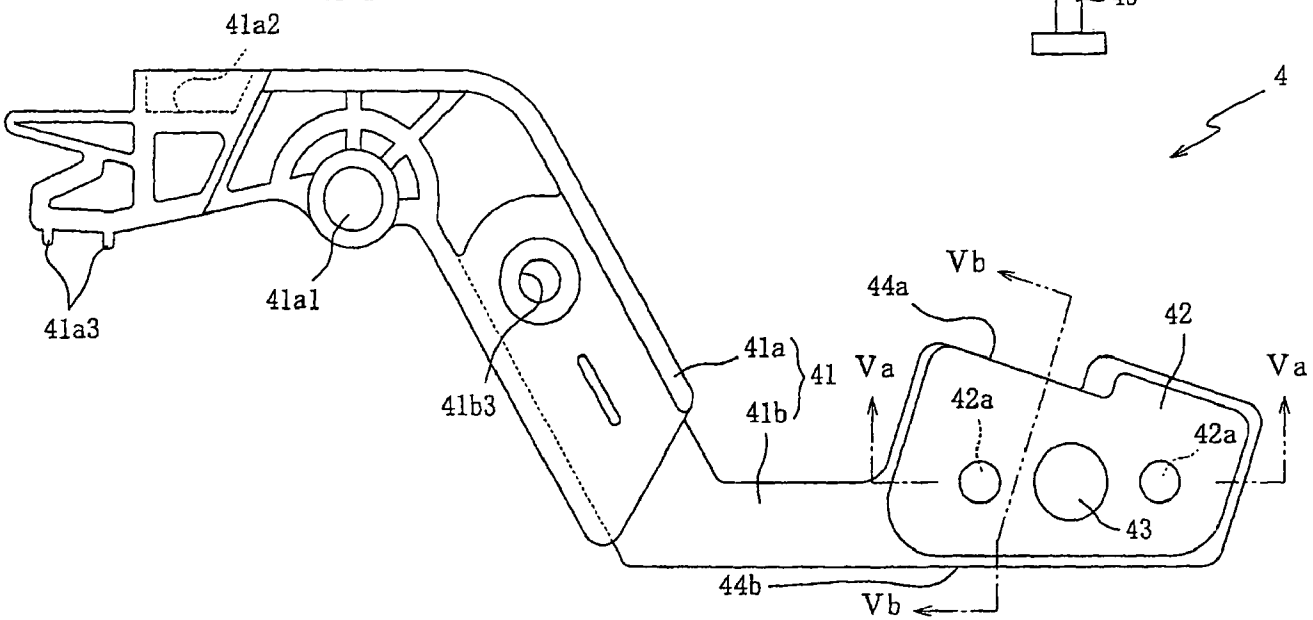
FIGURE 4 ( b )

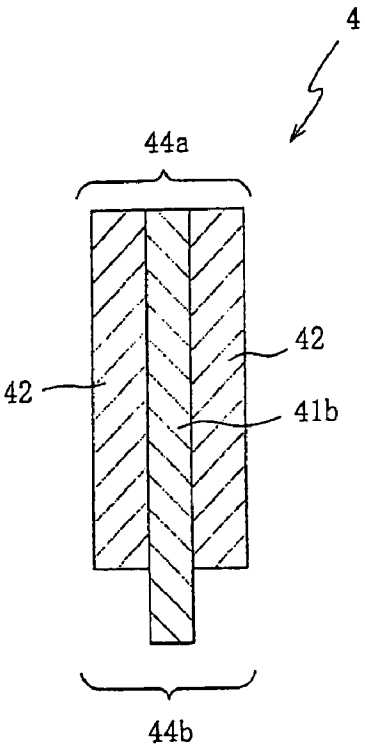
FIGURE 5 ( b )
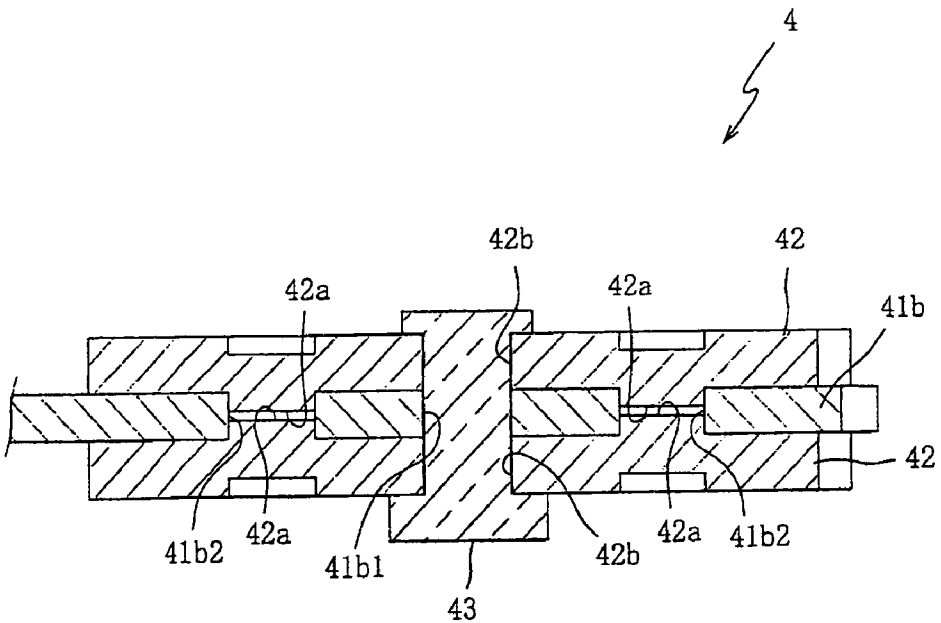
FIGURE 5 ( a )

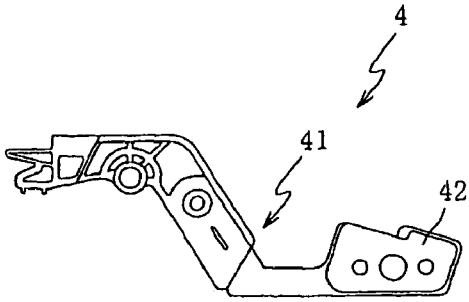
FIGURE 6 ( a )
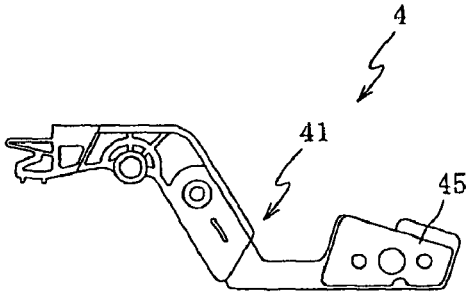
FIGURE 6 ( b )
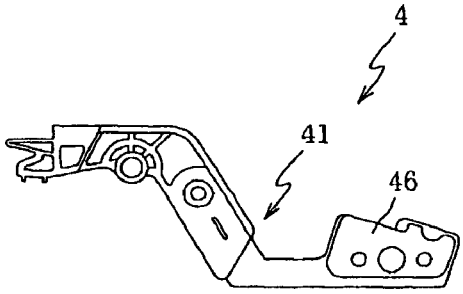
FIGURE6 ( c )
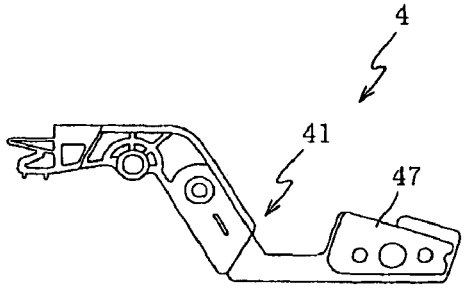
FIGURE6 ( d )
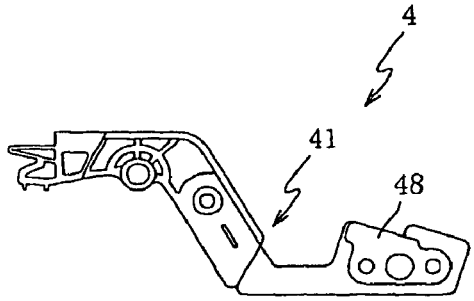
FIGURE 6 ( e )
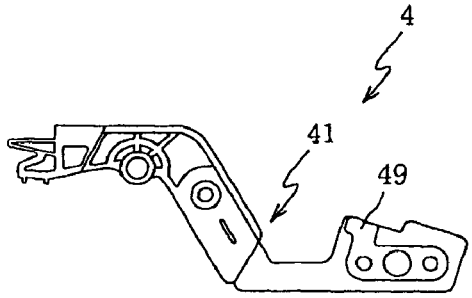
FIGURE 6( f )

HAMMER KEYBOARD SYSTEM AND CHASSIS

CROSS-REFERENCE TO RELATED PATENT APPLICATIONS

Japan Priority Application 2003-138978, filed May 16, 2003 including the specification, drawings, claims and abstract, is incorporated herein by reference in its entirety. Japan Priority Application 2003-139057, filed May 16, 2003 including the specification, drawings, claims and abstract, is incorporated herein by reference in its entirety. This application is a Divisional of U.S. application Ser. No. 10/833,767, filed Apr. 28, 2004, incorporated herein by reference in its entirety.

BACKGROUND OF THE INVENTION

1. Field of the Invention

The present invention relates to a hammer and a keyboard system and, in particular, to a hammer having a simplified structure and reduced costs and that maintains its capability as a mass body to impart a touch weight. The present invention also relates to a keyboard system comprising the hammer. In addition, the present invention relates to a chassis and, in particular, to a chassis in which the chassis main body and the control member are formed as a single unit and with which it is possible to miniaturize the design of the electronic musical instrument overall.

2. Description of Related Art

For some time, hammers have been installed in keyboard systems that are used in electronic pianos and the like. These hammers are provided for each key (for example, 88 keys) and are configured such that, when a key is pressed or released, because the corresponding hammer is linked to the key and swings, a touch weight is imparted that is the same as that for an acoustic piano.

With this kind of hammer, the arrangement of the layout must be limited to the space in the keyboard system, and the hammers are required to be formed in relatively complex shapes. In addition, weight is also needed in order for the hammer to function as the mass body that imparts the touch weight. Because of this, the hammer is furnished with a hammer main body constructed from a resin molding, which has a comparatively large degree of freedom for the shape and a load constructed from a metal material having a high relative density, enabling the weight to be increased. It is normal for the configuration to be such that the load is attached to the tip of the hammer main body.

Here, as the structure for the attachment of the load to the hammer main body, the method is known with which the weight is fixed to the hammer main body by means of riveting. For example, in Japanese Unexamined Patent Application Publication (Kokai) Number 2000-122652, a hammer is cited in which two mass plates (loads) are attached to the left and right attachment surfaces of the hammer main body so as to sandwich the hammer main body between them. By means of this hammer, after concave portions in both mass plates are aligned with protrusions on each of the attachment surfaces of the hammer main body and the plates are positioned, rivets are driven into each of the two rivet holes that have been drilled into the hammer main body and both mass plates. Thus, by this means, the two mass plates are fixed to the attachment surfaces of the hammer main body (Patent Reference 1).

In addition, it is usual for keyboard systems that are used with electronic pianos and the like to be configured with a chassis, a plurality (for example, 88) of keys that are supported axially so that they swing and that are lined up and disposed on the chassis in the left-right direction, and a plurality of hammers that are linked to the pressing or releasing of each of the keys and, by swinging, impart a touch weight that is the same as that of an acoustic piano. Here, it is necessary that the chassis be provided with a support section for supporting the keys and the hammers, making it possible for them to swing, and a control member that controls the swinging of the keys and the hammers, which swing due to the pressing or releasing of the keys. Alternatively, a guide member can be provided that guides the keys in the up and down direction at the time of pressing or releasing. For example, in Japanese Unexamined Patent Application Publication (Kokai) Number 2000-122852, a technology is cited in which the unit is furnished with a connecting bar that connects and fixes a chassis that has been divided in the left-right direction. The connecting bar forms the control member discussed above (Patent Reference 1).

Specifically, on each of the chassis, which have been divided into a plurality in the left-right direction, is respectively formed a support section that supports the keys on the rear edge section, a support section that supports the hammers on the center section, and a guide member that guides the keys on the front edge section. The front edges and the rear edges of each chassis are connected and fixed by a long shaped connecting bar. In addition, the bottom portion of the connection bar that connects and fixes the front edges of each chassis forms the control member that controls the lower limit of the swinging of the hammers.

However, with the attachment structure discussed above, it is necessary to drive high-cost rivets into a multiple number of places and the component count increases. In addition, since it is not possible to position each of the mass plates in the circumferential direction with respect to the hammer main body using only the alignment of the protrusions used for positioning and the concave portions, special work is required to position each of the rivet holes with the others. As a result, component and assembly costs increase because of the increase in the component count as well as the added complexity of the attachment work, and the product cost of the hammer overall rises.

Because of the plastic processing ability at the time of caulking, rivet metal having a comparatively low relative density such as aluminum and the like is used. Thus, when the number of locations in which the rivet holes are drilled in the mass plates is in proportion to the number of rivets employed, the weight of the hammer overall is lightened by that amount and it is not possible for the function of the mass plates that impart the touch weight to be fully manifested. In that case, the necessity arises to make the mass plates larger so as to maintain the required weight. This leads to the enlarging of the hammer overall.

In addition, with the chassis structure discussed above, since the connecting bar and the guide member are disposed on the front edge of the chassis, there is the problem that the space for arranging the wiring (the electrical cabling) and the edge plate (the wooden plate that is disposed below the front edge of the white keys) and the like is reduced by that amount. As a result, when the electronic musical instrument is assembled, the wiring and the edge plate protrude further outward than the front edge of the white keys by the amount for the disposition of the connecting bar and the guide member. Thus, the electronic musical instrument becomes larger and its appearance is blemished.

In addition, when the connecting bar and the guide member are arranged on the front edge of the chassis in this manner, the position for the arrangement of the hammers must be shifted toward the rear edge of the chassis; since the chassis is extended toward the back, the electronic musical instrument becomes enlarged by this amount also.

The present invention solves the problems discussed above and has as its object the provision of a hammer and a keyboard system that has a simplified hammer structure and, while designing for a reduction in the component and assembly costs, maintains the capability of the mass body to impart a touch weight. In addition, it has as its object the provision of a chassis in which the chassis main body is molded in a single unit with the control member and that makes possible the reduction in size of the electronic musical instrument.

SUMMARY OF THE INVENTION

According to embodiments of the present invention, the hammer is a hammer that is installed in a keyboard system that has a plurality of keys and that imparts a touch weight by a swinging that is linked to the pressing or release of the keys, and the hammer is furnished with a hammer main body that has three pass-through holes and is supported in the keyboard system so that it can swing freely, and two mass plates that are attached on both sides of the hammer main body such that the hammer main body is sandwiched between them on both side surfaces, and a rivet member that is driven in such that the rivet is inserted and passes through a linking hole of one of the mass plates to a linking hole of the other mass plate via a pass-through hole of the hammer main body. The previously mentioned hammer main body has three pass-through holes drilled and disposed. On the other hand, on the mass plates, two protuberances that can each fit into two of the pass-through holes from among the three pass-through holes when the mass plates are attached to the hammer main body, and a linking hole that links with the remaining one pass-through hole are arranged protruding and drilled and disposed.

Also, when the mass plates are fixed to the hammer main body, first the two mass plates are each attached to both side surfaces of the hammer main body so that they sandwich the hammer main body between them, and the two protrusions on both of the mass plates fit into two of the pass-through holes from among the three pass-through holes of the hammer main body. As a result, since both of the mass plates are positioned in the radial direction and in the circumferential direction with respect to the hammer main body and the remaining pass-through hole in the hammer main body is linked with the linking holes in the two mass plates, the rivet member can be driven in such that it is inserted through from the linking hole of one mass plate to the linking hole of the other mass plate via the pass-through hole on the hammer main body. By this means, the two mass plates are each fixed to both sides of the hammer main body.

Also, a control member is provided in the keyboard system that is linked to the pressing of the keys and that contacts the swinging hammer main body and controls the swinging. The two mass plates are structured such that the surfaces of the sides that come into contact with the control member become roughly the same flat surface with the surface of the hammer main body that comes into contact with the control member.

Also, a control member is provided in the keyboard system that is linked to the releasing of the keys, and that contacts the swinging hammer main body and controls the swinging. The two mass plates are structured such that the surfaces of the sides that come into contact with the control member are set further toward the back than the surface of the hammer main body that comes into contact with the control member.

The two mass plates are formed in shapes that are roughly identical with each other and are attached in positions that are roughly symmetrical with respect to the hammer main body. The two protrusions of the mass plates are each formed so that the protrusions protrude by means of half piercing processing and are arranged in a position that is roughly linearly symmetrical with respect to the imaginary line that passes roughly through the center of the linking hole.

The hammer is furnished with a base plate member comprising a metal material in which the three pass-through holes are formed, and a holder member that comprises a resin material. The holder member and the base plate member are mutually joined by means of insert molding, and at least one of the pass-through holes from among the three pass-through holes is configured as a hole for positioning the base plate member at the time of the insert molding.

The mass plates of each of the hammers are each formed in shapes having differing aspects for each weight and are configured such that it is possible to identify at least one of either the weight of the previously mentioned hammer or the type of the corresponding key based on the shape of the mass plate.

The chassis is furnished with a chassis main body with which the plurality of keys and hammers are supported such that swinging is possible, and an upper limit control member and a lower limit control member that contact the upper surface and the lower surface of the hammers, respectively, to control the swinging of the hammers. The upper limit control member and lower limit control member are formed from a resin material in a single unit with the previously mentioned chassis main body.

When a key is pressed, the hammer that is linked to the key is swung toward one side and, due to the relevant swinging, the upper surface of the hammer comes into contact with the upper limit control member that has been formed in a single unit with the chassis main body. Because of this, the swinging range of the hammer at the time of the key pressing is limited. On the other hand, when the key is released, the hammer that is linked to the releasing of the key is swung toward the other side, and due to the relevant swinging, the lower surface of the hammer comes into contact with the lower limit control member that has been formed in a single unit with the chassis main body. By this means, the swinging range of the hammer at the time of the key releasing is limited.

The chassis includes a pair of plate members that are disposed extending toward the outside, while facing each other and holding the hammers between them. They are formed in a single unit on one end of the chassis main body, and one of the pair of plate members that is positioned on top serves as the upper limit control member. The other one that is positioned on the bottom serves as the lower limit control member. A guide member that guides the movement of the keys upward or downward is disposed on the upper base surface of the previously mentioned plate member that serves as the upper limit control member. The plate member that serves as the upper limit control member and the guide member are connected by a rib member.

The chassis is configured such that, in those cases where the keys have been pressed, the plate member that serves as the upper limit member becomes sandwiched between the lower surface of the key that has swung due to the pressing and upper surface of the hammer that has swung with the linkage to the pressed key.

In accordance with the hammer of the present invention, three pass-through holes are drilled and disposed in the hammer main body and, together with this, two protrusions are formed on the mass plates. Therefore, when the mass plates are attached to the hammer main body, due to the fact that the two protrusions on the mass plates each fit into two of the pass-through holes from among the three pass-through holes of the hammer main body, it is possible to position the mass plates not only in the radial direction but also in the circumferential direction with respect to the hammer main body. In addition, by means of this positioning, it is possible for the linking holes of the mass plates to be linked through to the pass-through hole of the hammer main body. Accordingly, there is no need to carry out special work, as with the hammers of the past, to align each of the rivet holes with the others when the rivet is driven in and, since the attaching work is simplified, there is the advantageous result that the assembly costs can be reduced by that amount and it is possible to reduce the product cost of the hammer overall.

In addition, in accordance with the present invention, due to the fact that the two protrusions on the mass plates each fit into the pass-through holes, each of the mass plates is positioned and fixed not only in the radial direction but also in the circumferential direction with respect to the hammer main body. Therefore, even in those cases where the number of rivet members that are driven in is only one, it is possible to reliably fix each of the mass plates in the radial and circumferential directions without any rattling. As a result, since there is no need to drive in high-cost rivets in a plurality of locations as with the hammers of the past; and the number of components as well as the number of work processes for driving the rivets is reduced, there is the advantageous result that it is possible to lower the component costs and assembly costs by that amount and to further reduce the product costs of the hammer overall.

In addition, in accordance with the hammer of the present invention, each of the mass plates is fixed to the hammer main body by means of one rivet member. Therefore, since the number of drilling locations for the linking holes and pass-through holes in the mass plates and the hammer main body is kept to the lowest number possible and the diminution of the weight of the mass plates and the hammer man body can be limited, there is the advantageous result that it is possible to maintain the weight of the hammer overall by that amount. As a result, since the weight of each of the structural members that is required as a mass body that imparts the touch weight can be maintained with smaller outside dimensions, there is the advantageous result that it is possible to control the enlarging of the hammer overall.

In addition, in accordance with the keyboard system of the present invention, since it has the hammer of the present invention, there is the advantageous result that it is possible to lower the product costs for the keyboard system overall.

In accordance with the chassis of the present invention, the upper limit and lower limit control members, which control the swinging range of the hammer, are formed in a single unit with the chassis main body. Therefore, since there is no need to dispose a connecting bar and the like, which is required to form the control member in the case of the chassis of the past, on the front edge of the chassis and the space for the arrangement of the wiring and the edge plate and the like is maintained, there is the advantageous result that it is possible to appropriately dispose the wiring and the edge plate and the like on the front edge of the chassis and to limit the enlargement of the electronic musical instrument as well as damage to its appearance.

In addition, since there is no need to dispose and position the hammers shifted toward the rear edge of the chassis by the amount for the disposition of the connecting bar and the depth of the chassis can be shortened by that amount, there is the advantageous result that, in that area also, it is possible to limit the enlargement of the electronic musical instrument.

BRIEF DESCRIPTION OF THE DRAWINGS

A detailed description of embodiments of the invention will be made with reference to the accompanying drawings, wherein like numerals designate corresponding parts in the several figures.

FIG. 4(*a*) is a top surface view of the hammers and FIG. 4(*b*) is a lateral surface view of the hammers according to an embodiment of the present invention;

FIG. 5(*a*) is a cross-section view along the line Va-Va of FIG. 4(*b*) and FIG. 5(*b*) is a cross-section view along the line Vb-Vb of FIG. 4(*b*) according to an embodiment of the present invention;

FIG. 6 is a front elevation that shows the six types of hammers that are used in the keyboard system according to an embodiment of the present invention;

DETAILED DESCRIPTION OF THE PREFERRED EMBODIMENTS

In the following description of preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the preferred embodiments of the present invention.

Figure 1:
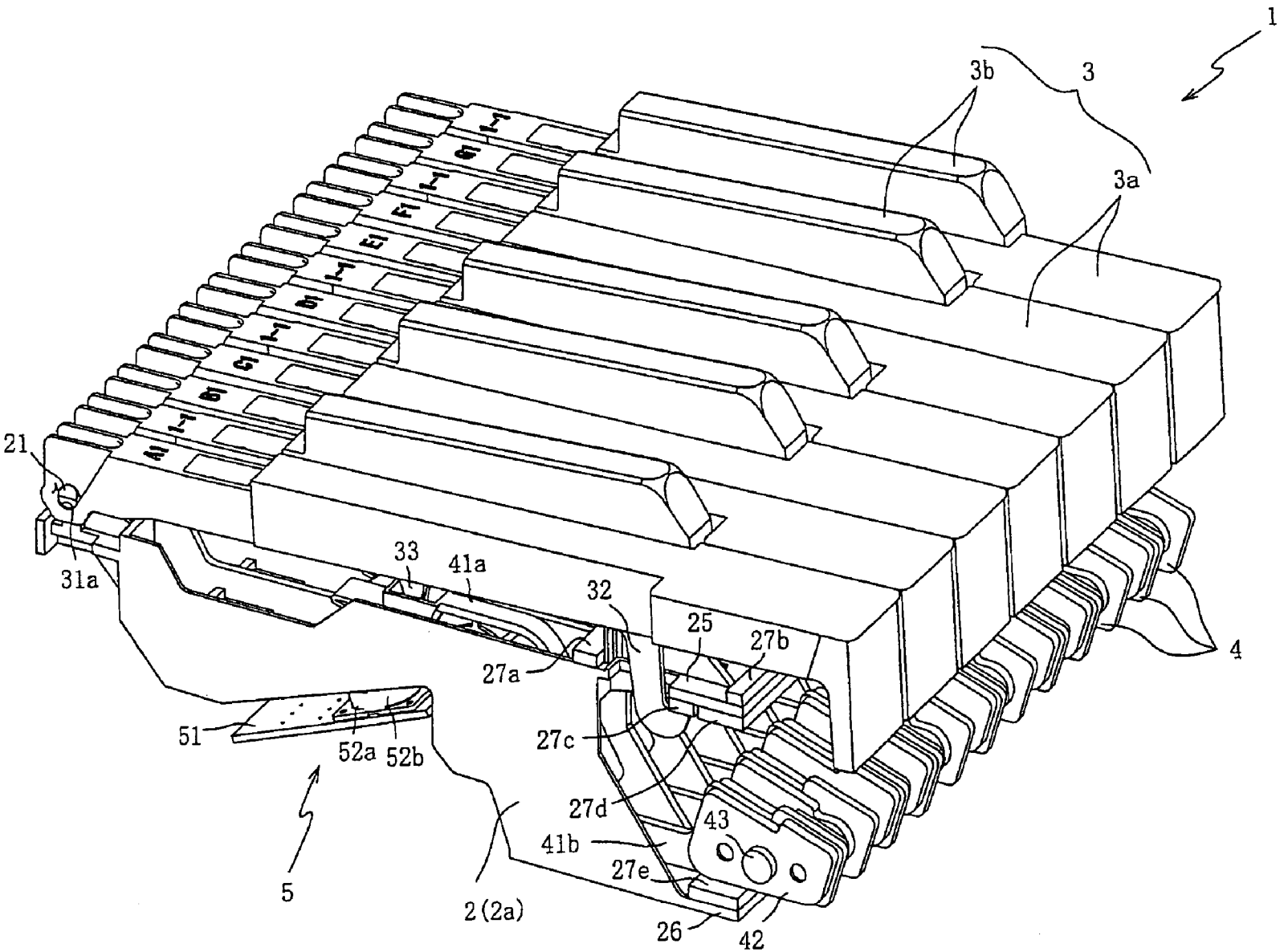
FIG. 1 is a perspective view of a keyboard system with hammers and chassis according to an embodiment of the present invention.

FIG. 1 is an oblique drawing of the keyboard system 1 in which the hammer 4 in one preferred embodiment of the present invention is used. Incidentally, in FIG. 1, the keyboard system 1 is abbreviated in its width in the right to left direction (the direction in which the row of keys 3 is disposed) and only a section of 12 keys is shown in the drawing. First, an explanation will be given of the exterior structure of the keyboard system 1, referring to FIG. 1.

The keyboard system 1 is configured for operation of the keyboard by the performer and is a system for the detection of the operating state of the keyboard installed in an electronic musical instrument such as an electronic piano (not shown in the drawing) and the like. The keyboard system 1 primarily is furnished with and comprises, as is shown in FIG. 1, a chassis 2, which is formed as a single unit from a resin material, a plurality of keys 3 (for example, 88 keys) comprising the white keys 3*a* and the black keys 3*b*, which are supported on the chassis 2 such that they are free to swing, and the hammers 4, which, together with being disposed for each of the keys 3, are linked to and made to swing with the pressing and releasing of the keys 3.

The keys 3 (the white keys 3*a* and the black keys 3*b*) are, as is shown in FIG. 1, arranged on top of the chassis 2 (the upper part in FIG. 1) and the hammers 4 are arranged on the inside of the chassis 2 corresponding to each of the keys 3, and they are each arranged in respective rows in the left to right direction of the chassis 2. In addition, the front edge section of the chassis 2 (the right side in FIG. 1) is, as is shown in FIG. 1, configured so that it is open. Because of this, the front edge sections of the hammers 4 (the right side in FIG. 1) are exposed below the keys 3 (the bottom in FIG. 1) and it is possible to see and ascertain the external shape of the front edge sections from the outside.

The hammers 4, as will be discussed later, are configured such that it is possible to identify the weight and the attachment position from the external shape. Therefore, since, due to the fact that the front edge sections of the hammers 4 are exposed from the chassis 2, it is possible to easily view and ascertain the front end sections of each of the hammers 4 from the outside in an inspection at the time of assembling or at the time of shipping the keyboard system 1, the inspection can be carried out with good efficiency. Thus, it is possible to prevent with certainty the erroneous attachment of the hammers 4.

The key switches 5, for the detection of the pressing information for the keys 3 (the white keys 3*a* and the black keys 3*b*) are installed on the rear surface side (the side opposite that of the keys 3) of the chassis 2. The switches 5 are furnished with the base plate 51 that is screwed onto and attached to the chassis 2, and the first and second switches 52*a* and 52*b*, which are disposed on the upper surface of the base plate 51. In those cases where the first and second switches 52*a* and 52*b* are pressed in succession by the switch pressing section 41*a*3 of the hammers 4 (refer to FIG. 8) and turned on, the key pressing information (the velocity) of the keys 3 is detected based on the difference in the times that each of the switches 52*a* and 52*b* have been on.

Figure 2:
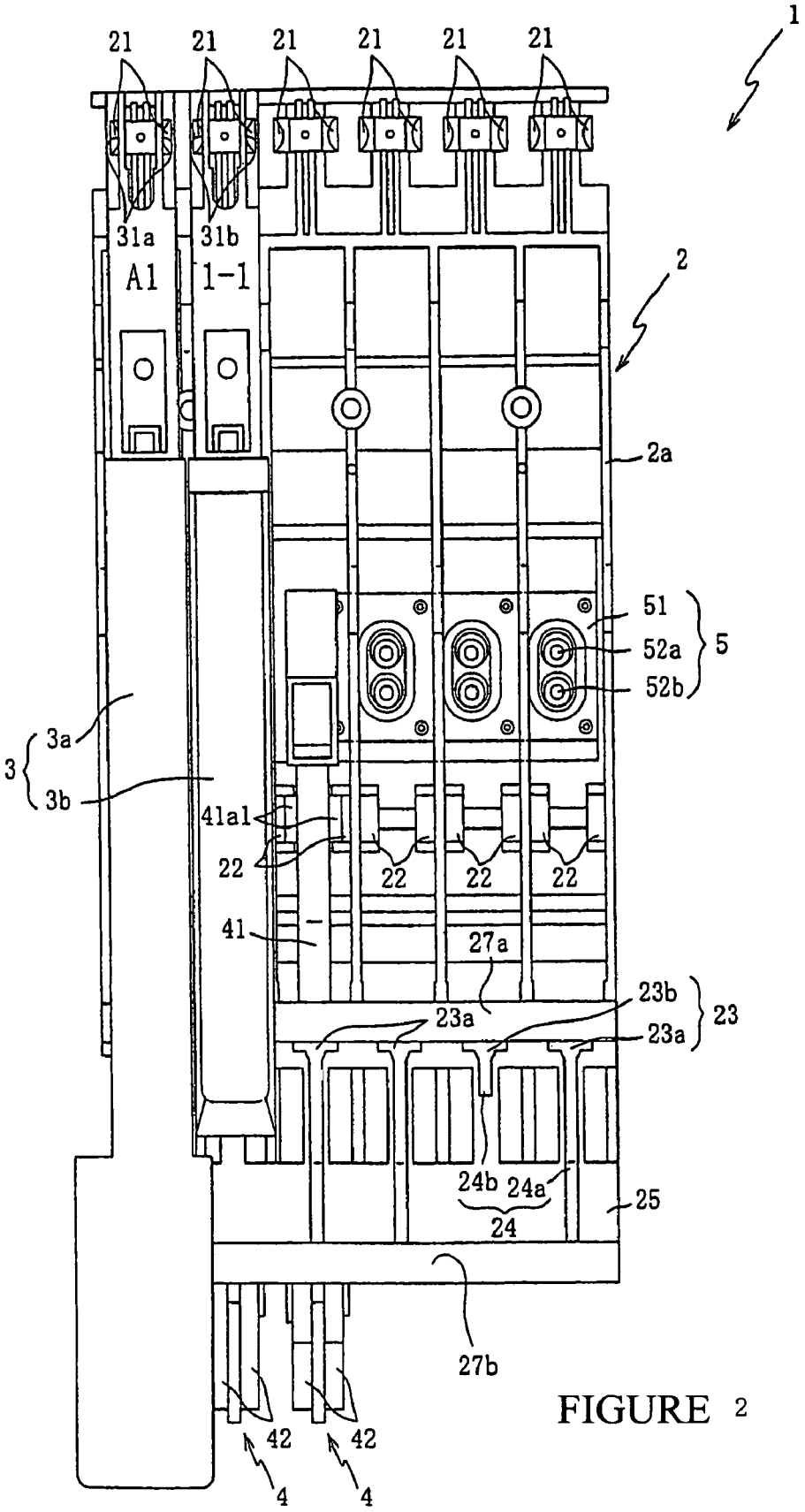
FIG. 2 is a top surface view of the keyboard system according to an embodiment of the present invention.
Figure 3:
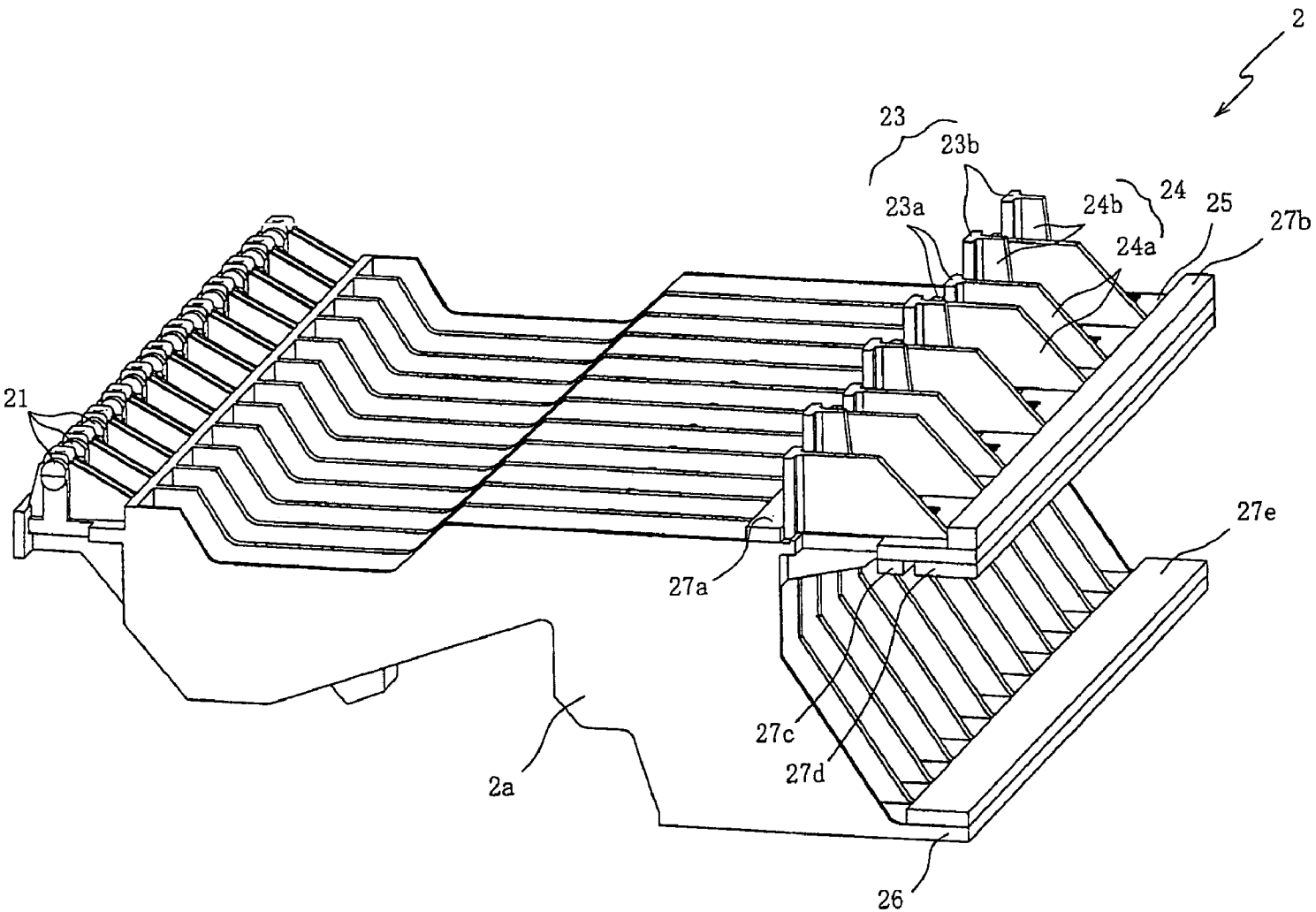
FIG. 3 is a perspective view of the chassis according to an embodiment of the present invention.

Next, explanations will be given regarding the chassis 2, the keys 3, and hammers 4 while referring to FIG. 2 and FIG. 3. FIG. 2 is a drawing of the top surface of the keyboard system 1 and FIG. 3 is an oblique view drawing of the chassis 2. In FIG. 2, the keyboard system 1 is abbreviated in the left to right direction (this is the direction in which the keys 3 are disposed in a row and is the left to right direction in FIG. 2) and only a six key portion is shown in the drawing. In addition, in FIG. 2, a state in which a portion of the keys 3 and the hammers 4 have been removed is shown in the drawing.

The chassis 2 provides a framework for the keyboard system 1 and, as is shown in FIG. 2, is furnished with the chassis main body 2*a* that comprises a resin material and is configured in a roughly rectangular shape viewed from above. The chassis is also configured with each of the structural members including axial key support protrusions 21, concave hammer axial support sections 22, key guide members 23, ribs 24, upper extension plate 25, lower extension plate 26, and the like, formed as a single unit.

The axial key support protrusions 21 are protrusions for axially supporting the keys 3 (the white keys 3*a* and the black keys 3*b*) so that they are free to swing and, as is shown in FIG. 2 and FIG. 3, are formed for each key 3 on the side (the top in FIG. 2 and the left side in FIG. 3) of the rear edge of the chassis 2 (the chassis main body 2*a*). As is shown in FIG. 2, the protrusions match up with the axial support holes 31*a* and 31*b*, which are drilled in the side wall portions of the keys 3. By means of this relevant matching up, the chassis 2 supports (braces) the keys 3 axially so that the keys are free to swing.

The concave hammer axial support sections 22 are concave sections for the axial support of the hammers 4 such that they are free to swing and, as is shown in FIG. 2, are roughly in the center portion of the chassis 2 (the chassis main body 2*a*). The support sections are formed for each hammer 4 as concave sections with a cross-section view that is roughly a "U" shape having the top (the front side in FIG. 2) open. The concave hammer axial support sections 22 match up with the axial support protrusions 41*a*1 that protrude from both side walls of the hammers 4. By means of this relevant matching up, the chassis 2 supports (braces) the hammers 4 axially so that they are free to swing.

With the chassis 2 (the chassis main body 2*a*) as viewed from above, as is shown in FIG. 2, the arrangement is such that the first and second switches 52*a* and 52*b* are exposed above the concave hammer axial support sections 22 (the top in FIG. 2). In those cases where a hammer 4 that is linked to the pressing of a key 3 swings, the first and second switches 52*a* and 52*b* are pressed by the switch pressing section 41*a*3 that is formed on the rear of the back end (the top in FIG. 2) of the hammer 4 (refer to FIG. 8).

The guide members 23 guide the keys 3, which have been pressed or released, in the vertical direction (the direction that is perpendicular to the FIG. 2 page surface and the up-down direction in FIG. 3) and limit rattling by the keys 3 in the horizontal direction (the left to right direction in FIG. 2). As is shown in FIG. 2 and FIG. 3, the guides are disposed standing on the front edge side (the bottom in FIG. 2 and the right side in FIG. 3) of the chassis 2 (the chassis main body 2*a*) for each key 3. The guide members 23 are inserted between the side walls of the keys 3 from the bottom side of the keys (the rear side of the FIG. 2 page surface) and limit the rattling of the keys 3 in the horizontal direction by means of their contact on the inside with both side walls of the keys 3.

With regard to the guide members 23, the system is configured furnished with the white key guide members 23*a* and the black key guide members 3*b* and are members for respectively guiding the white keys 3*a* and the black keys 3*b*. The height at which the white key guide members 23*a* are disposed standing is, as is shown in FIG. 3, made somewhat lower than the height at which the black key guide members 23*b* are disposed standing due to the fact that the initial position of the white keys 3*a* is lower than that of black keys 3*b* (Refer to FIG. 1).

In addition, on one side (the bottom in FIG. 2 and the right side in FIG. 3) of the guide members 23 (the white key guide members 23*a* and the black key guide members 23*b*), as is shown in FIG. 2 and FIG. 3), the ribs 24 (the white key ribs 24*a* and the black key ribs 24*b*) are disposed standing and, by means of the relevant ribs 24, one side of the guide members 23 and the top surface side (the front side in FIG. 2 and the top in FIG. 3) of the upper extension plate, which will be discussed later, are mutually linked.

By means of this linkage, not only are the rigidity and strength of the guide members 23 maintained and is it possible to firmly limit the rattling in the horizontal direction of the keys 3, but the rigidity and strength of the upper extension plate 25 can be maintained at the same time. Therefore, even in those cases where an upper extension plate 25 is hit strongly by a key 3 or a hammer 4 due to the pressing of the key 3 (refer to FIG. 8), it is possible to prevent the worsening of the performer's operating sensation at the time of pressing the keys or releasing the keys due to damage to the upper extension plate 25 or its deformation before they happen.

As discussed above, since the ribs 24 (the white key ribs 24*a* and the black key ribs 24*b*) are disposed on the top surface side of the upper extension plates 25, it is possible for the relevant ribs 24 to be inserted between the side walls of the keys 3 from the bottom side of the keys 3. Therefore, by means of the arrangement of the ribs 24, it is possible to avoid a restriction of the swinging range of the keys 3 while limiting the curtailment of the space in which the keys 3 and other members are arranged.

Figure 7:
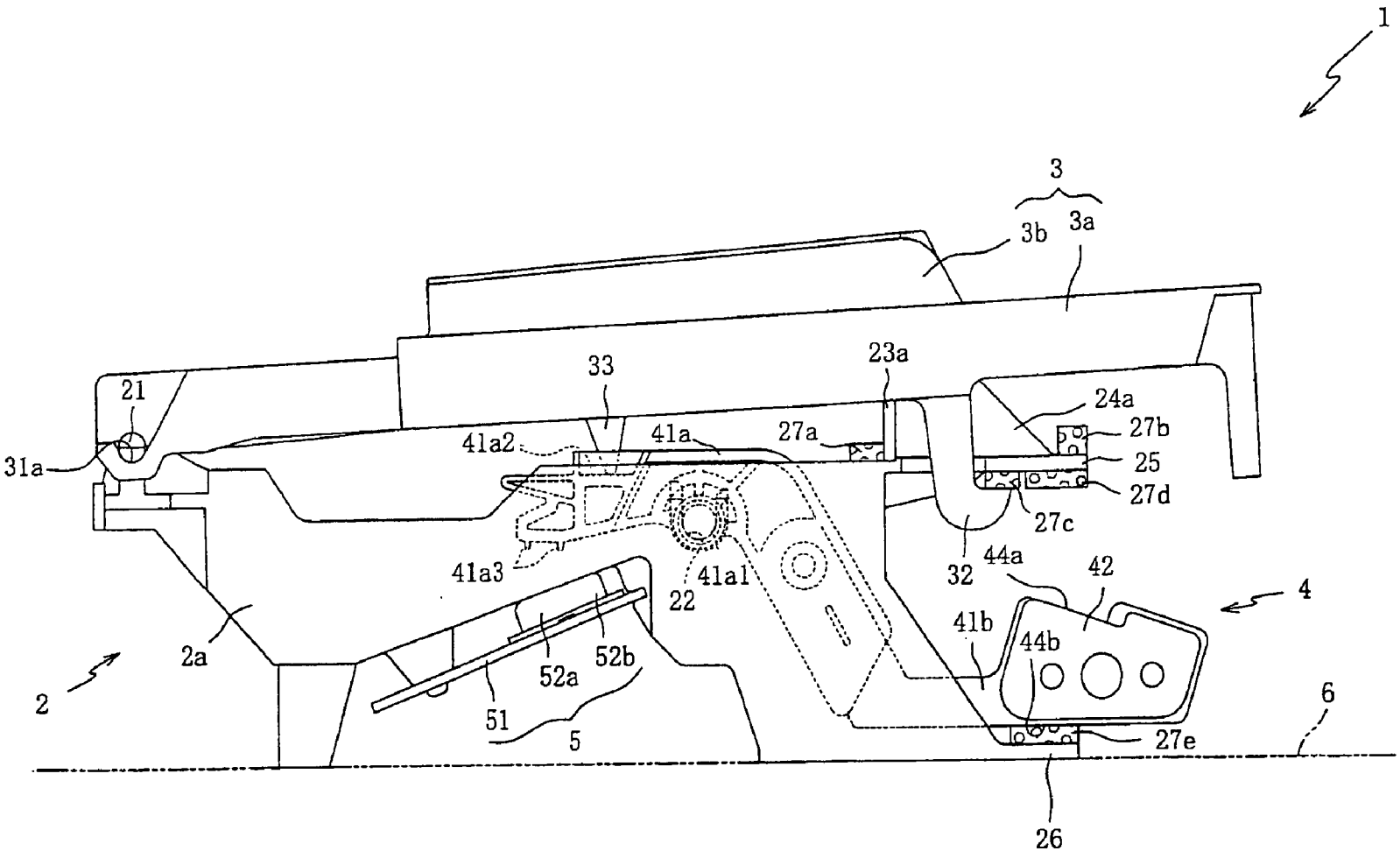
FIG. 7 is a lateral surface view of the keyboard system according to an embodiment of the present invention.
Figure 8:
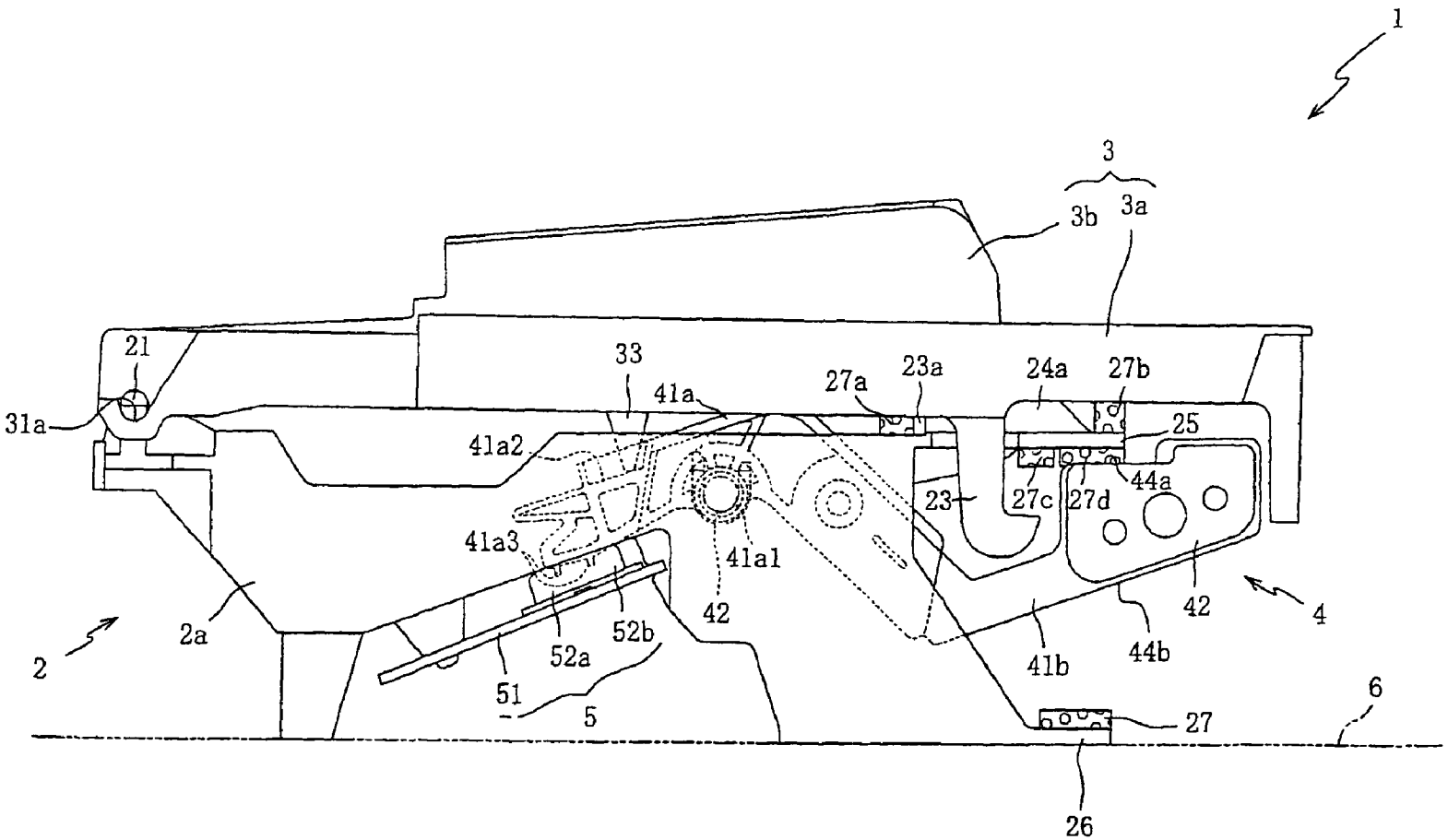
FIG. 8 is a lateral surface view of the keyboard system according to an embodiment of the present invention.

The upper extension plate 25 is a member that, in those cases where a key 3 has been pressed, comes into contact with the lower surface of the key 3 and the upper surface of the hammer 4 and restricts respectively the lower limit position of the key 3 and the upper limit position of the hammer 4 (refer to FIG. 8). Together with this, in those cases where a key 3 is released, the plate comes into contact with the stopper section 32 of the key 3 and restricts the upper limit position of the key 3 (refer to FIG. 7). On the other hand, the lower extension plate 26 is a member that, in those cases where a key 3 has been released, comes into contact with the lower surface of the hammer 4 and restricts the lower limit position of the hammer 4 (refer to FIG. 7).

The upper extension plate 25 and the lower extension plate 26 are, as is shown in FIG. 3, disposed extending roughly horizontally in the direction outward from the front edge side (the right side in FIG. 3) of the chassis 2 (the chassis main body 2*a*) and are arranged mutually opposite each other separated by a specified interval. As a result, the front edge side (the right side in FIG. 3) of the chassis 2 is formed as an opening of roughly a "U" shape viewed from the side and having the opening facing toward the outside. The front end sections of the hammers 4 are arranged between the opposing faces of the upper extension plate 25 and the lower extension plate 26 (refer to FIG. 1).

In this manner, since the upper and lower extension plates 25 and 26, which regulate the swinging movement of the keys 3 and the hammers 4, are formed as a single unit on the chassis 2 (the chassis main body 2*a*), there is no need, as with the chassis of the past, to dispose a connecting bar and the like, which is required to form a control member, on the front edge of the chassis (refer to FIG. 1). Therefore, space to arrange the wiring and the edge plate and the like is maintained and since it is possible to dispose the wiring and the edge plate and the like on the front edge side of the chassis 2 appropriately, in other words, without having them protrude toward the outside, the increase in the size of the electronic musical instrument and the damage to its external appearance can be limited.

In addition, there is no need as with the chassis of the past to shift the position at which the hammers 4 are disposed toward the rear edge side (the top in FIG. 2 and the left side in FIG. 3) of the chassis 2 (the chassis main body 2*a*) by the amount that a connecting bar is arranged. Since it is possible to shorten the depth of the chassis 2 (the width in the vertical direction in FIG. 2 and the width in the left to right direction in FIG. 3) by that amount, in that aspect also the increase in the size of the electronic musical instrument and the damage to its external appearance can be limited.

In addition, since, due to the fact that the front edge section (the right side in FIG. 3) of the chassis 2 is configured as an open section having an opening and, as has been discussed above, it is possible to ascertain the external shape of the front edge section of the hammers 4 (the right side in FIG. 1) visually from the outside (refer to FIG. 1), the front edge section shape of each of the hammers 4 can be easily confirmed visually with inspections at the time of assembly or at the time of shipping of the keyboard system 1. Thus, it is possible to carry out the inspection with good efficiency and the erroneous installation of the hammers 4 can be prevented with certainty.

As is shown in FIG. 3, the cushioning materials 27*a* and 27*b* are affixed to the upper surface of the upper extension plate 25 (the upper surface in FIG. 3), the cushioning materials 27*c* and 27*d* are affixed to the lower surface of the upper extension plate 25 (the lower surface in FIG. 3), and the cushioning material 27*e* is affixed to the upper surface of the lower extension plate 26 (the upper surface in FIG. 3). These cushioning materials 27*a* through 27*e* are members that fulfill the role of a shock absorbing material or a damping material and comprise such materials as, for example, felt or urethane foam and the like that should absorb the shock at the time that the swinging of the keys 3 or the hammers 4 is limited.

The keys 3, as has been discussed above, comprise the white keys 3*a* and the black keys 3*b* and, as is shown in FIG. 2, are arranged on the upper surface (the front side of FIG. 2) of the chassis 2 (the chassis main body 2*a*). The white keys 3*a* and the black keys 3*b* are formed from a resin material in a long rectangular shape having a cross-section that is roughly the shape of the letter "U" with the bottom surface (the rear side of the FIG. 2 page) opened. The white key guide members 23*a* and the black key guide members 23*b*, which have been discussed above, are inserted on the insides from the bottom side and are in contact with the inner surfaces of the respective side walls. By means of the relevant inner contact, the rattling of the white keys 3*a* and the black keys 3*b* is limited in the left to right direction (the left to right direction in FIG. 2).

In addition, with both the white keys 3*a* and the black keys 3*b*, the axial support holes 31*a* and 31*b*, which have a roughly circular shape viewed from the front, are drilled and disposed in the side walls of the rear end of the keys (the top in FIG. 2). The axial support holes 31*a* and 31*b* are in locations that match up with the key axial support protrusions 21, which are discussed above, that are disposed protruding on the rear edge section (the top in FIG. 2) of the chassis 2 (the chassis main body 2*a*) and by means of the relevant matching up, the white keys 3*a* and the black keys 3*b* are supported (braced) axially by the chassis 2 so that they are free to swing.

The stopper members 32 are formed in the white keys 3*a* and the black keys 3*b* in the shape of the letter "L" viewed from the side extending downward (in the direction of the rear of the FIG. 2 page) from the side walls of the keys (refer to FIG. 7 and FIG. 8). By means of the contact made by the stopper member 32 with the upper extension plate 25 (the cushioning material 27*c*), the upper limit position of the white keys 3*a* and the black keys 3*b* is controlled when they are released (refer to FIG. 7).

In addition, the linking protrusions 33, which have a roughly pointed shape, are formed on the white keys 3*a* and the black keys 3*b* disposed extending downward (in the direction of the rear of the FIG. 2 page) from the bottom surface of the keys (refer to FIG. 7 and FIG. 8). The white keys 3*a* and the black keys 3*b* are linked (contact) to the hammers 4 through the linking protrusions 33 and, by means of the relevant linking to the hammers 4, are lifted to their initial positions by the weight of the hammers 4 when the keys are released (refer to FIG. 7) while on the other hand, when the keys are pressed, a specified touch weight is imparted by the weight of the hammers 4 (refer to FIG. 8).

The hammers 4, as is shown in FIG. 2, are, when viewed from the top, accommodated in the interior of the chassis 2 (the chassis main body 2*a*) and in those cases where the white keys 3*a* and the black keys 3*b* are attached to the upper surface of the chassis 2, the hammers are covered by the white keys 3*a* and the black keys 3*b* such that they are not visible. However, it should be noted that the front end sections of the hammers 4 are, as has been discussed above, exposed to the outside from below the white keys 3*a*, and visual confirmation is possible from the outside (refer to FIG. 1).

On both sides of the hammer 4 (the hammer main body 41), as is shown in FIG. 2, the axial support protrusions 41*a*1, which have a roughly circular shape viewed from the front, are disposed protruding. The axial support protrusions 41*a*1 match up with the concave hammer axial support sections 22 that are disposed recessed in the chassis 2 (the chassis main body 2*a*) and, by means of the relevant matching up, the hammers 4 are supported (braced) axially by the chassis 2 such that they are free to swing. Here, an explanation will be given of the detailed configuration of the hammers 4 while referring to FIG. 4.

FIG. 4(*a*) is a top surface drawing of the hammer 4 and FIG. 4(*b*) is a lateral surface drawing of the hammer 4. In FIG. 4(*a*) the hammer 4 is shown in a state prior to assembly and in FIG. 4(*b*) the hammer 4 is shown in the state after assembly.

Here, in the keyboard system 1 of this preferred embodiment, six types of hammer 4 each having different weights are used (refer to FIG. 6) but, as will be discussed later, other than the fact that the exterior shapes of the mass plates 42 are different, all of the hammers 4 are ones that each have roughly an identical configuration. Therefore, the explanation that will be given below will use one of the hammers 4 (refer to FIG. 6(*a*)) as a representative illustration.

The hammer 4 is a member that, due to the fact that the hammer is linked to and swings with the pressing or releasing of the key 3, imparts a touch weight that is the same as that of an acoustic piano and is furnished with a hammer main body 41, two mass plates 42, and a rivet 42. The hammer main body 41 is furnished with a resin holder 41*a* that comprises a resin material, and a metal base plate 41*b* that is joined to the resin holder 41*b* by means of insert molding and comprises a metal material. As is shown in FIG. 4(*b*), the hammer main body is configured in the form of a bent curved plate having roughly the shape of the letter "S" viewed from the side.

On both sides of the resin holder 41*a*, as is shown in FIGS. 4(*a*) and (*b*), the axial support protrusions 41*a*1, which were discussed above and have roughly a circular shape viewed from the front, are disposed protruding. In addition, on the rear end section (the left side in FIGS. 4(*a*) and (*b*)) of the resin holder 41*a*, the concave linking portion 41*a*2 is formed on the upper surface (the top in FIG. 4(*b*)), and the switch pressing portion 41*a*3 is formed on the lower surface (the bottom in FIG. 4(*b*)). The concave linking portion 41*a*2 is a concave portion for linking to the linking protrusion 33 of the key 3 discussed above, and the switch pressing portion 41*a*3 is a protrusion for pressing and turning on each of the first and second switches 52*a* and 52*b* of the key switch 5 discussed above.

As is shown in FIG. 4(*a*), on the attachment surfaces for attaching the mass plates 42, which will be discussed later, that are on the front end section (the right side in FIG. 4) of the metal base plate 41*b*, three pass-through holes are drilled and disposed. The center pass-through hole is the rivet hole 41*b*1 through which the rivet 43, which will be discussed later, is inserted and the remaining two pass-through holes are the positioning holes 41*b*2 into which the positioning protrusions 42*a* of the mass plates 42 that will be discussed later are inserted. The rivet hole 41*b*1 and the positioning holes 41*b*2 are, as is shown in FIG. 4(*b*), roughly evenly spaced and in a straight line. In other words, the holes are arranged such that both of the positioning holes 41*b*2 are linearly symmetrical with respect to an imaginary line that passes roughly through the center of the rivet hole 41*b*1.

In addition, the positioning hole 41*b*3 is drilled and disposed on the rear end section (the left side in FIG. 4) of the metal base plate 41*b*. The positioning hole 41*b*3 is a hole for positioning the metal base plate 41 when insert molding is done and matches up with a protrusion used for positioning that is disposed protruding in the mold. The rivet hole 41*b*1 discussed above also doubles as a positioning hole when insert molding is done and the metal base plate 41*b* is positioned in the mold by matching up the rivet hole 41*b*1 and the positioning hole 41*b* with the protrusions used for positioning that are disposed protruding in the mold.

In this manner, the metal base plate 41*b* is configured such that it is possible for the rivet hole 41*b*1 to double as a positioning hole at the time that insert molding is done. Therefore, the separate drilling and disposing of a positioning hole for when the relevant insert molding is done can be avoided, and it is possible to preserve the weight of the metal base plate 41*b* by that amount. As a result, since it is possible to configure the metal base plate 41*b* to the required weight with smaller dimensions, its capability as a mass body that imparts a touch weight can be maintained while preventing making the hammer 4 larger overall.

The mass plates 42 are members that fulfill the role of weights that increase the weight of the hammer 4 and two are attached each on the left and right side surfaces (the attachment surfaces) of the metal base plate 41*b* so as to sandwich the metal base plate 41*b*. The two mass plates 42 are formed having mutually roughly the identical exterior shape and are attached in positions that are roughly symmetrical with respect to the metal base plate 41*b*. Since it is possible by this means to make the balance of the right and left of the hammer 4 overall appropriate, in those cases where a key 3 has been pressed or released, side to side shaking when the hammer 4 swings is prevented. Since the relevant hammer 4 can be made to swing smoothly, it is possible to reduce the production of mechanical noise.

On one side surface of each of the mass plates 42 (the surface that is aligned with the metal base plate 41*b*), as is shown in FIG. 4(*a*), two positioning protrusions 42*a* are disposed protruding by means of so-called half pierce processing, and the rivet hole 42*a* is drilled and disposed roughly in the middle between the positioning protrusions 42*a*. The positioning protrusions 42*a* and the rivet hole 42*b* are roughly evenly spaced and in a straight line. In other words, the arrangement is such that both of the positioning protrusions 42*a* are linearly symmetrical with respect to an imaginary line that passes roughly through the center of the rivet hole 42*b*.

Therefore, for the two mass plates, the processed surfaces (the processing directions) of which are mutually different, the half pierce processing of the positioning protrusions 42*a* and the punch type for carrying out the punch out processing of the rivet hole 42*b* can be made common to the two mass plates 42 and it is possible to design for a reduction of the cost of the high priced molds. As a result, the production cost of the mass plates 42 is reduced, and it is possible to lower the product cost of the hammer 4 overall.

The positioning protrusions 42*a* are protrusions for the positioning of the mass plates with respect to the metal base plate 41*b* and, as has been discussed above, are inserted into the positioning holes 41*b*2 of the metal base plate 41*b*. In addition, the rivet hole 42*b* is a pass-through hole through which the rivet 43, which will be discussed later, is inserted and, when the positioning protrusions 42*a* have been inserted into the positioning holes 41*b*2, as will be discussed later, the configuration is such that the mass plate rivet hole is linked through to the rivet hole 41*b*1 of the metal base plate 41*b*1 (refer to FIG. 5(*a*)).

The rivet 43 is a member for fixing the two mass plates 42 to the metal base plate 41*b* and comprises a metal material that has superior plastic processing properties and a comparatively low relative density (for example, aluminum and the like), which is configured in a cylindrical shape having a bearing surface on one end. Here, an explanation will be given regarding the method of assembly of the hammer 4 while referring to FIG. 5(*a*).

FIG. 5(*a*) is a cross-section drawing of the hammer 4 along the line Va-Va of FIG. 4(*b*) and a portion of the metal base plate 41*b* has been omitted from the drawing.

At the time of the assembly of the hammer 4, first, the two mass plates 42 are attached to the left and right attachment surfaces of the metal base plate 42*a* and, as is shown in FIG. 5(*a*), the two positioning protrusions 42*a* are inserted into the positioning holes 41*b*2. By this means, each of the mass plates 42 is positioned with respect to the metal base plate 41*b* in the circumferential direction (the direction of rotation), not merely in the radial direction (the parallel direction); and, in addition, by means of this positioning, the rivet holes 42*b* of both of the mass plates 42 are, as is shown in FIG. 5(*a*), linked through to the rivet hole 41*b*1 of the metal base plate 41*b*.

Therefore, there is no need as with the hammer assembly work of the past to adjust the attachment position of the mass plates and to carry out separate work to align the positions of each of the rivet holes in order to drive in the rivet. Since the attaching work is simplified, the cost of the attachment of the mass plates 42 is reduced by that amount and it is possible to lower the product cost of the hammer 4 overall.

After the attachment of the mass plates 42, next, a rivet 43 is driven in such that the rivet is inserted through from the rivet hole 42*b* of one of the mass plates 42 (the bottom of FIG. 5(*a*)) to the rivet hole 42*b* of the other mass plate 42 (the top in FIG. 5(*a*)) via the rivet hole 41*b*1 of the metal base plate 41*b*, and the end section is bottom end processed. By this means, as is shown in FIG. 5(*a*), the two mass plates 42 are fixed to the metal base plate 41*b* and the assembly of the hammer 4 is completed.

In this manner, each of the mass plates 42 is configured such that the two positioning protrusions 42*a* are inserted into the positioning holes 41*b*2 and, by this means, they are positioned and fixed not only in the radial direction with respect to the metal base plate 41*b* but also in the circumferential direction. Therefore, since it is possible to reliably carry out the fixing of both of the mass plates 42 to the metal base plate 41*b* by merely driving in one rivet 43 and, since there is no need to drive in high cost rivets in a multiple number of locations as with the hammers of the past and the number of components as well as the number of driving-in work processes are cut, the component costs and assembly costs are reduced and it is possible to further lower the product cost of the hammer 4 overall.

In addition, due to the fact that it is possible to fix both of the mass plates 42 to the metal base plate 41*b* using one rivet 43, the number of locations for the drilling and disposition of the rivet holes 42*b* and 41*b*1 in the two mass plates 42 and the metal base plate 41*b* is kept to a minimum and it is possible to limit the lightening of the weight of the two mass plates 42 and the metal base plate 41*b* by that amount. As a result, since it is possible to maintain the required weight while configuring the mass plates 42 and the metal base plate 41*b* with smaller dimensions, the capability of the mass plates to impart a touch weight can be maintained while preventing the enlarging of the hammer 4 overall.

The explanation will return to FIG. 4. As has been discussed above, when the two mass plates 43 are attached to the left and right surfaces (the attachment surfaces) of the metal base plate 41*b* and the assembly of the hammer 4 is completed, as is shown in FIG. 4(*b*), the upper and lower contact surfaces 44*a* and 44*b* are respectively formed on the upper surface and the lower surface (the top and bottom in FIG. 4(*b*)) of the mass plate 42 attachment section.

The upper contact surface 44*a*, in those cases where the key 3 has been pressed, is the location that comes into contact with the upper extension plate 25 (the cushioning material 27*d*), which acts as the upper limit member (refer to FIG. 8); and the lower contact surface 44*b*, in those cases where the key 3 has been released, is the location that comes into contact with the lower extension plate 26 (the cushioning material 27*e*), which is the lower limit member (refer to FIG. 7). An explanation will be given here regarding the detailed configuration of the upper and lower contact surfaces 44*a* and 44*b* while referring to FIG. 5(*b*).

FIG. 5(*b*) is a cross-section drawing of the hammer 4 along the line Vb-Vb of FIG. 4(*b*). The upper contact surface 44*a* is, as is shown in FIG. 5(*b*), configured as roughly a single flat surface by the attachment of the two mass plates 42 at roughly the same height as the metal base plate 41*b*. Therefore, since it is possible to ensure the area of contact with the cushioning material 27*d* (refer to FIG. 8), the pressure of the action on the cushioning material 27*d* at the time of pressing the key 3 is reduced and the load on the relevant cushioning material can be limited. As a result, it is possible to design for the increased life of the cushioning material 27*d* and to limit the degradation of the capabilities of the cushioning material 27*d* as a shock absorbing material or a damping material due to use.

On the other hand, the lower contact surface 44*b* is, as is shown in FIG. 5(*b*), configured in a roughly pointed shape having a taper overall due to the fact that two mass plates are attached recessed toward the rear (the top direction in FIG. 5(*b*)) with respect to the metal base plate 41*b*. Therefore, the contact with the cushioning material 27*e* (refer to FIG. 7) is made smooth and, since the shock absorbing qualities can be improved, it is possible to limit the mechanical noise that is produced when the key 3 is released. As a result, it is possible to control interference with the performance qualities due to the production of unnecessary sounds.

FIG. 6 is a drawing that shows all six of the types of hammer 4 that are used in the keyboard system of this preferred embodiment. FIG. 6(*a*) through FIG. 6(*d*) are front elevation drawings of the hammers 4 that are used with the white keys 3*a* and FIG. 6(*e*) and FIG. 6(*f*) are front elevation drawings of the hammers that are used with the black keys 3*b*. In FIG. 6, in order to simplify the drawings and make them easy to understand, the keys for each of the structural members (for example, the "41*b*" that indicates the metal base plate and the like) have been omitted.

In the keyboard system 1 of this preferred embodiment, as has been discussed above, six types of hammers 4 each having different weights are used. The hammers that are shown in FIGS. 6(*a*) through (*d*) are used with the white keys 3*a*, and they are shown in order of decreasing weight (in other words, for increasingly higher tones) with the hammer that is shown in FIG. 6(*a*) being the heaviest (in other words, for a low lone) through FIG. 6(*d*), the lightest. In addition, the hammers 4 that are shown in FIGS. 6(*e*) and (*f*) are ones that are used with the black keys with the one that is shown in FIG. 6(*e*) heavier (in other words, for a lower tone) than the one that is shown in FIG. 6(*f*).

With each of these hammers 4, as is shown in FIGS. 6(*a*) through (*f*), due to the fact that the exterior shape of each of the mass plates 42 and 45 through 49 is changed, each of the hammers is configured with a different weight, but the hammer main body 41 (the resin holder 41*a* and the metal base plate 41*b*) itself is used in common. As a result, with only these outer dimensions, it is possible to make the stamping form of the higher-priced metal base plate 41*b*, which is the larger part as well as the insert molding form for the union with the resin holder 41*a*, common for each of the hammers 4 (in other words, the keyboard system 1). Thus, the mold costs can be reduced and it is possible to design for a lowering of the product cost of the hammer 4 by that amount.

In addition, due to the fact that the hammer main body 41 is made common to all of the hammers 4 in this manner, it is possible to produce each weight of the hammer 4 by changing only the exterior shape of each mass plate 42 and 45 through 49, in other words, without changing the exterior shape of the resin holder 41*a* or the metal base plate 41*b*. Therefore, not only is there no need to change the high-priced insert mold, but since it is possible to make it unnecessary to change the mold for the chassis, the variations of hammers 4 can be easily increased and the degrees of freedom of design can be increased by that amount. As a result, for example, it is possible to flexibly comply with even unexpected design changes.

In addition, due to the fact that the weight of each of the hammers 4 is changed by the exterior shape of each of the mass plates 42 and 45 through 49, it is possible to utilize the exterior shapes of the relevant mass plates 42 and 45 through 49 as identification information that indicates the weight of each of the hammers 4 and the installation location. As a result, in those cases where, as with the chassis 2 of this preferred embodiment, the configuration is such that the front edge section is formed as an open section, and it is possible to visually confirm the exterior shape of each of the mass plates 42 and 45 through 49 from the outside. For example, the shape of the front end section of each of the hammers can be easily ascertained visually in an inspection at the time of the assembly or at the time of shipping of the keyboard system 1, it is possible to carry out the inspection with good efficiency. Thus, the erroneous installation of the hammers 4 can be prevented with certainty.

Next, an explanation will be given regarding the action in those cases where a key 3 of a keyboard system 1 that has been configured as above has been pressed or released while referring to FIG. 7 and FIG. 8. FIG. 7 and FIG. 8 are lateral surface drawings of the keyboard system 1. FIG. 7 shows the state in which the key 3 has been released, in other words, the initial state. FIG. 8 shows the state in which the key 3 has been pressed.

With the chassis 2, as is shown in FIG. 7 and FIG. 8, the bottom edge surface (the bottom surface in FIG. 7 and FIG. 8) of the chassis main body 2*a* is in contact with the rack plate 6 in two places and is screwed and fixed to the rack plate 6 by the screwing of screws (not shown in the drawing) to the relevant contact surface. The explanation will be given below of the case in which a white key 3*a* is pressed or released; however, since the case of a black key 3*b* is the same, that explanation will be omitted.

In the initial state that is shown in FIG. 7, when a white key 3*a* is pressed, the relevant white key 3*a* swings downward (toward the bottom in FIG. 7) with the axial support protrusion 21 as the center of rotation and, as is shown in FIG. 8, due to the fact that the bottom surface comes into contact with the cushioning material 27*a* and 27*b*, the lower limit position is regulated. In that case, the white key 3*a* is guided downward by the white key guide 23*a* so that there is no rattling in the left to right direction.

On the other hand, the hammer 4 is linked to the pressing of the white key 3*a*. Due to the fact that the concave linking portion 41*a*2 is pressed downward by the linking protrusion 33 of the white key 3*a*, the front end section (the right side in FIG. 7 and FIG. 8) swings upward with the axial support protrusion 41*a*1 as the center of rotation. By this means, upper contact surface 44*a* of the hammer 4, as is shown in FIG. 8, comes into contact with the cushioning material 27*d* and the upper limit position is regulated. In this case, since the upper contact surface 44*a* is configured as a single flat surface (refer to FIG. 5(*b*)), an action in which there is an excessive load on the cushioning material 27*s* is limited and the long life of the cushioning material 27*d* can be designed for.

In addition, along with the swinging of the hammer 4, as is shown in FIG. 8, due to the fact that the switch pressing portion of the hammer 4 presses and turns on the first and second switches 52*a* and 52*b* of the key switch 5, the key pressing information (the velocity and the like) for the white key 3*a* is detected and a musical tone is emitted from a speaker (not shown in the drawing) in conformance with the results of the detection.

In the pressed state that is shown in FIG. 8, when the white key 3*a* is released, the relevant white key 3*a* is swung upward (toward the top in FIG. 8), in other words, the key returns to the initial position, with the axial support protrusion 21 as the center of rotation and, as is shown in FIG. 7, due to the fact that the stopper member 32 comes into contact with the cushioning material 27*c*, the upper limit position is regulated.

On the other hand, the hammer 4 is linked to the releasing of the white key 3*a*. Due to the fact that pressure downward by the white key 3*a* (the linking protrusion 33) on the concave linking section 41*a*2 is released, the front end section (the right side in FIG. 7 and FIG. 8) swings downward with the axial support protrusion 41*a*1 as the center of rotation. Because of this, the lower contact surface 44*b* of the hammer 4, as is shown in FIG. 7, comes into contact with the cushioning material 27*e* and the lower limit position is regulated. In this case, since the lower contact surface 44*b* is configured in a roughly pointed form having a tapered shape overall (refer to FIG. 5(*b*)), the contact with the cushioning material 27*e* is made smoothly and the production of mechanical noise is limited.

An explanation of the present invention has been given above based on a preferred embodiment; however, the present invention is in no way one that is limited to the preferred embodiment that has been discussed above and the fact that various modifications and changes are possible that do not deviate from and are within the scope of the essentials of the present invention can be easily surmised.

For example, in this preferred embodiment, an explanation has been given of the case in which the two mass plates 42 and 45 through 49 are fixed to the metal base plate 41*b* by driving in the rivet 43. However, the relevant fixing method is not necessarily limited to this and, for example, it may be configured such that the two mass plates 42 and 45 through 49 are fixed to the metal base plate 41*b* by welding.

As the welding method here, the use of spot welding (resistance welding), in which the two mass plates 42 and 45 through 49 that have been securely attached to both surfaces of the metal base plate 41*b* are inserted between a pair of electrodes and localized heating is carried out by the flow of current with the application of a voltage to the electrodes, is preferable.

In those cases where the two mass plates 42 are fixed to the metal base plate 41*b* by welding (not limited to spot welding), the drilling and disposition of the rivet holes 41*b*1 and 42*b* in the metal base plate 41*b* and each of the mass plates 42 and 45 through 49 can be omitted. Because of this, since the pass-through holes that are drilled and disposed in the metal base plate 41*b* and the mass plates 42 and 45 through 49 can be reduced and the required weight can be maintained with smaller exterior dimensions, it is possible to maintain the capability of the hammer as a mass body that imparts a touch weight while preventing the enlarging of the hammer 4 overall.

In addition, although no particular explanation was given in this preferred embodiment with regard to the material properties (the characteristics) of each of the cushioning materials 27*a* through 27*e*, there is no need for them all to be configured identically and it may be configured with different material properties for each of the cushioning materials 27*a* through 27*e* in conformance with the arrangement position and the like. Each of the cushioning materials 27*a* through 27*e* may comprise a plurality of materials having different material properties that are laminated in the direction of the thickness.

While particular embodiments of the present invention have been shown and described, it will be obvious to those skilled in the art that the invention is not limited to the particular embodiments shown and described and that changes and modifications may be made without departing from the spirit and scope of the appended claims.

What is claimed is:

1. A chassis that is used for a keyboard system having a plurality of keys and a plurality of hammers, the chassis comprising a chassis main body with which the plurality of keys and the plurality of hammers are supported such that swinging is possible and such that each of the hammers has a lengthwise dimension extending along a first direction from a pivot point of the hammer to a weighted end of the hammer, and each of the keys has a lengthwise dimension extending along a second direction generally the same as the first direction from a pivot point of the key to a free end of the key, and an upper limit control member and a lower limit control member with which the upper surface and the lower surface of the hammers are respectively contacted to control the swinging of the hammers when the hammers swing from the pressing or the releasing of the keys that are supported by the chassis main body, wherein the chassis main body comprises a plurality of walls;

wherein each of the walls is disposed between a corresponding pair of adjacent ones of the hammers;

wherein each of the walls comprises a portion that extends at least from an elevation of the lower limit control member at least to an elevation of the upper limit control member; and wherein a lengthwise dimension of each of the walls extends from a pivot end of the key to the weighted end of the hammer, such that the walls are configured to provide a housing for the hammers with respect to the first direction.

2. The chassis cited in claim 1, further comprising a pair of plate members that are disposed extending toward the outside of the chassis while facing each other and holding the hammers between them and formed in a single unit on one end of the chassis main body, one of the pair of plate members being positioned on top and serving as the upper limit control member and the other being positioned on bottom and serving as the lower limit control member; and a guide member that guides the movement of the keys upward or downward disposed on an upper base surface of the plate member that serves as the upper limit control member.

3. The chassis cited in claim 2, wherein the plate member that serves as the upper limit control member and the guide member are connected by a rib member.

4. The chassis cited in claim 3, wherein the chassis is configured such that, in those cases where the keys have been pressed, the plate member that serves as the upper limit member becomes sandwiched between the lower surface of the key that has swung due to the pressing and the upper surface of the hammer that has swung due to linkage to the pressed key.

5. The chassis cited in claim 2, wherein the chassis is configured such that, in those cases where the keys have been pressed, the plate member that serves as the upper limit member becomes sandwiched between the lower surface of the key that has swung due to the pressing and the upper surface of the hammer that has swung due to linkage to the pressed key.

6. The chassis cited in claim 2, further comprising:

cushioning material disposed on at least one surface of the pair of plate members, the cushioning material being adapted to absorb shock when the at least one surface is contacted by a key or a hammer.

7. The chassis cited in claim 1, wherein a front edge of the chassis main body is open and adapted to expose a front edge section of the plurality of hammers.

8. The chassis cited in claim 1, wherein the chassis main body is divided into a plurality of rows, each row being adapted to accommodate at least one of the plurality of keys and at least one of the plurality of hammers.

9. The chassis cited in claim 8, wherein each row is provided with axial key support protrusions adapted to engage axial support holes in the keys.

10. The chassis cited in claim 8, wherein each row is provided with hammer axial support sections adapted to support axial support protrusions in the hammers.

11. The chassis cited in claim 10, wherein the hammer axial support sections have a U-shaped configuration.

12. The chassis cited in claim 10, wherein at least two switches are exposed above the hammer axial support sections in each row.

13. The chassis cited in claim 1, wherein the chassis main body is provided with a plurality of axial key support protrusions adapted to engage axial support holes in the keys.

14. The chassis cited in claim 1, wherein the chassis main body is provided with hammer axial support sections adapted to support axial support protrusions in the hammers.

15. The chassis cited in claim 14, wherein the hammer axial support sections have a U-shaped configuration.

16. The chassis cited in claim 14, wherein a plurality of switches are exposed above the hammer axial support sections.

17. The chassis cited in claim 1, further comprising:

cushioning material disposed on at least one surface of the upper limit control member and the lower limit control member, the cushioning material being adapted to absorb shock when the at least one surface is contacted by a key or a hammer.

18. The chassis cited in claim 1, wherein the walls comprise at least three walls, and wherein each of the at least three walls defines surfaces that extend along the first direction.

19. The chassis cited in claim 1, wherein a plurality of gaps are defined by the walls, each of the gaps defined between an associated pair of adjacent walls, wherein a first hammer of the hammers is located in a first one of the gaps, and wherein a second hammer of the hammers is located in a second one of the gaps.

20. The chassis cited in claim 19, wherein each of the first hammer and the second hammers swings within its associated gap upon the pressing or the releasing of a corresponding one of the keys.

21. The chassis cited in claim 1, wherein the walls comprise at least three walls, wherein each of the at least three walls extends generally along a corresponding one of a plurality of planes, and wherein the planes are generally parallel to one another.

22. The chassis cited in claim 1, wherein the upper limit control member and lower limit control member are formed from a resin material in a single unit with the chassis main body.

23. A chassis for a keyboard system having a plurality of keys and a plurality of hammers, the chassis comprising a chassis main body adapted to support the plurality of keys and the plurality of hammers such that swinging is possible, and an upper limit control member adapted to limit the swinging of the plurality of hammers during pressing of the keys by contacting the upper surface of the hammers;

a lower limit control member adapted to limit the swinging of the plurality of hammers during releasing of the keys by contacting the lower surface of the hammers, wherein the chassis main body comprises a plurality of walls;

wherein each of the walls is disposed between a corresponding pair of adjacent ones of the hammers;

wherein each of the walls comprises a portion that extends at least from an elevation of the lower limit control member at least to an elevation of the upper limit control member; and wherein a lengthwise dimension of each of the walls extends from a pivot end of the key to a weighted end of the hammer, such that the walls are configured to provide a housing for the hammers with respect to a direction from a pivot end of the hammer to the weighted end of the hammer.

24. The chassis cited in claim 23, wherein the chassis main body is adapted to support the hammers such that each of the hammers has a lengthwise dimension extending along a first direction from a pivot point of the hammer to a weighted end of the hammer, and each of the keys has a lengthwise dimension extending along a second direction generally the same as the first direction from a pivot point of the key to a free end of the key.

25. The chassis cited in claim 23, wherein the chassis main body further comprises a plurality of hammer axial support sections adapted to support pivot points of the hammers and disposed between a first end of the chassis main body and a second end of the chassis main body opposite the first end of the chassis main body;

wherein the chassis further comprises:

a first key control member adapted to limit the swinging of the keys during the pressing of the keys; and a second key control member adapted to limit the swinging of the keys during the releasing of the keys; and wherein the upper limit control member, the lower limit control member, the first key control member and the second key control member are disposed adjacent the second end of the chassis main body.

26. The chassis cited in claim 25, wherein the chassis main body further comprises a plurality of axial key support protrusions adapted to engage pivot points of the keys and disposed adjacent the first end of the chassis main body; and wherein the second end of the chassis main body is open to expose a front edge section of the plurality of hammers.

27. The chassis cited in claim 23, wherein the chassis main body comprises a first plate member adapted to support the lower limit control member; and wherein the first plate member is joined to each wall of the plurality of walls.

28. The chassis cited in claim 27, wherein the chassis main body further comprises a second plate member having a first surface and a second surface opposite the first surface;

wherein the upper limit control member and the second key control member are disposed on the second surface of the second plate member; and wherein the first key control member is disposed on the first surface of the second plate member.

29. The chassis cited in claim 28, wherein the second plate member is joined to each wall of the plurality of walls.

30. The chassis cited in claim 23, wherein the chassis main body further comprises a plurality of guide members for guiding swinging of the keys upon the pressing and the releasing of the keys, and wherein each of the guide members is disposed between a corresponding pair of adjacent ones of the keys.

31. The chassis cited in claim 23, wherein the upper limit control member and lower limit control member are formed from a resin material in a single unit with the chassis main body.

32. A chassis for a keyboard system having a plurality of keys and a plurality of hammers, the chassis comprising means for supporting the plurality of keys and the plurality of hammers such that swinging is possible, and upper means for limiting the swinging of the plurality of hammers during pressing of the keys by contacting the upper surface of the hammers;

lower means for limiting the swinging of the plurality of hammers during releasing of the keys by contacting the lower surface of the hammers, wherein the means for supporting comprises a plurality of walls;

wherein each of the walls is disposed between a corresponding pair of adjacent ones of the hammers;

wherein each of the walls comprises a portion that extends at least from an elevation of the lower means for limiting the swinging of the hammers at least to an elevation of the upper means for limiting the swinging of the hammers; and wherein a lengthwise dimension of each of the walls extends from a pivot end of the key to a weighted end of the hammer, such that the walls are configured to provide a housing for the hammers with respect to a direction from a pivot end of the hammer to the weighted end of the hammer.

33. The chassis cited in claim 32, wherein the means for supporting is adapted to support the hammers such that each of the hammers has a lengthwise dimension extending along a first direction from a pivot point of the hammer to a weighted end of the hammer, and each of the keys has a lengthwise dimension extending along a second direction generally the same as the first direction from a pivot point of the key to a free end of the key.

34. The chassis cited in claim 32, wherein the upper means for limiting the swinging and the lower means for limiting the swinging are formed from a resin material in a single unit with the means for supporting.

* * * * *